US006021206A

United States Patent [19]

McGrath

[11] Patent Number: 6,021,206

[45] Date of Patent: *Feb. 1, 2000

[54] METHODS AND APPARATUS FOR PROCESSING SPATIALISED AUDIO

[75] Inventor: David Stanley McGrath, Bondi, Australia

[73] Assignee: Lake DSP Pty Ltd, Sydney, Australia

[ * ] Notice: This patent issued on a continued prosecution application filed under 37 CFR 1.53(d), and is subject to the twenty year patent term provisions of 35 U.S.C. 154(a)(2).

[21] Appl. No.: 08/723,614

[22] Filed: Oct. 2, 1996

[51] Int. Cl.[7] ..... H04R 5/00

[52] U.S. Cl. ..... 381/310; 381/74

[58] Field of Search ..... 381/17, 25, 63, 381/24, 61, 74, 310, 309

[56] References Cited

U.S. PATENT DOCUMENTS

| | | | |
|---|---|---|---|
| 3,962,543 | 6/1976 | Blauert et al. | 381/25 |
| 4,081,606 | 3/1978 | Gerzon | 381/19 |
| 5,173,944 | 12/1992 | Begault | 381/24 |
| 5,371,799 | 12/1994 | Lowe et al. | 381/25 |
| 5,438,623 | 8/1995 | Begault | 381/25 |
| 5,452,359 | 9/1995 | Inanaga et al. | 381/25 |

OTHER PUBLICATIONS

Proceedings of the Institute of Acoustics, The Production of Steerable Binaural Information From Two–Channel Surround Sources, D.A. Keating & M.P. Griffin, vol. 15, Part 7 (1993).

Computer Music Journal, 3–D Sound Spatialization Using Ambisonic Techniques, David G. Malham and Anthony Myatt, 19:4, pp. 58–70, Winter 1995.

Wireless World, Surround–Sound Psychoacoustics, Criterial for the design of matrix and discrete surround–sound systems, Gerzon, Dec. 1974.

*Primary Examiner*—Vivian Chang

*Attorney, Agent, or Firm*—Fulwider Patton Lee & Utecht, LLP

[57] ABSTRACT

The invention relates to an apparatus for sound reproduction of a sound information signal having spatial components, the apparatus includes:

sound input means adapted to input the sound information signal;

headtracking means for tracking a current head orientation of a listener listening to the sound information signal via sound emission sources and to produce a corresponding head orientation signal;

sound information rotation means connected to the sound input means and the headtracking means and adapted to rotate said sound information signal to a substantially opposite degree to the degree of orientation of said current head orientation of the listener to produce a rotated sound information signal; and sound conversion means connected to the sound information rotation means for converting the rotated sound information signal to corresponding sound emission signals for outputting by the sound emission sources such that the spatial components of the sound information signal are substantially maintained in the presence of movement of the orientation of head of the listener.

23 Claims, 7 Drawing Sheets

90
91
92
93
95
S1
S2
S3
S4
97
98
99
dw1
dx1
dy1
dz1
dw2
dx2
dy2
dz2
dw3
dx3
dy3
dz3
dw4
dx4
dy4
dz4
W
X
Y
Z

METHODS AND APPARATUS FOR PROCESSING SPATIALISED AUDIO

FIELD OF THE INVENTION

The present invention relates to the field of audio processing and, in particular, to an audio environment wherein it is desired to give the user an illusion of sound (or sounds) located in space.

RELATED ART

The present invention relates to the field of processing spatialised audio sound wherein the sound system has the ability to "directionalise" sound so that when reproduced, the sounds appear to be coming from a certain direction in a certain environment.

For a general reference in this field, reference is made to the survey article "A 3D Sound Primer: Directional Hearing and Stereo Reproduction" by Gary S Kendall appearing in the Computer Music Journal, 19:, pp. 23–46, Winter 1995.

Prior known methods of producing audio outputs from directionalised sound have relied on the utilisation of multiple head related transfer functions in accordance with a listener's current head position. Further, only limited abilities have been known in the initial step of creating 3 dimensional audio environments and in the final step of rendering the 3 dimensional audio environment to output speakers such as headphones which are inherently stereo. The limitations include a failure to fully render 3 dimensional sound sources including reflections and attenuations of the sound source and a failure to accurately map 3 dimensional sound sources to output sound emission sources such as headphones or the like. Hence, prior art known systems have been substantially under utilised and there is a general need for an improved form of dealing with 3 dimensional sound creation.

DISCLOSURE OF THE INVENTION

In accordance with a first aspect of the present invention there is provided an apparatus for sound reproduction of a sound information signal having spatial components, the apparatus comprising:

sound input means adapted to input the sound information signal;

headtracking means for tracking a current head orientation of a listener listening to the sound information signal via sound emission sources and to produce a corresponding head orientation signal;

sound information rotation means connected to the sound input means and the headtracking means and adapted to rotate the sound information signal to a substantially opposite degree to the degree of orientation of the current head orientation of the listener to produce a rotated sound information signal; and sound conversion means connected to the sound information rotation means for converting the rotated sound information signal to corresponding sound emission signals for outputting by the sound emission sources such that the spatial components of the sound information signal are substantially maintained in the presence of movement of the orientation of head of the listener.

Preferably, the sound input means includes:

audio input means for the input of a series of audio signals having substantially no spatial components; and a sound component creation means connected to each of the audio signals and adapted to convert the audio signal to a corresponding sound information signal having spatial components locating the audio signal at a predetermined spatial location at a predetermined time.

The sound component creation means can also preferably include a means for combining the corresponding sound information signals into a single sound information signal having spatial components. Further there can be provided an environment creation means for creating a simulated environment for the audio signal including reflections and attenuations of the audio signal from the predetermined spatial location. The environment creation means can preferably also include:

a delay line connected to the audio signal for producing a number of delayed versions of the audio signals;

a series of sound sub-component creation means, connected to the delay line, each for creating a single sound arrival signal at the expected location of the listener, and a sound sub-component summation means, connected to each of the sound sub-component creation means and adapted to combine the single sound arrival signals so as to create said simulated environment.

The sound sub component creation means can comprise an attenuation filter, simulating the likely attenuation of the arrival signal, connected to a series of sub-component direction means creating directional components of the sound signal simulating an expected direction of arrival of the signal.

The environment creation means preferably includes a reverberant tail simulation means connected to the delay line and the sound sub-component creation means and adapted to simulate the reverberant tail of the arrival of the audio signal.

Preferably, the sound conversion means includes, for each sound emission source:

sound component mapping means mapping each of the spatial components of the sound information signal to a corresponding component sound emission source signal; and component summation means connected to each of the sound component mapping means and adapted to combine the component sound emission source signals to produce the corresponding sound emission signal for outputting by the sound emission source.

Preferably, the spatial component of the sound information signal include common mode and differential mode component and the component summation means adds together common mode components from corresponding sound component mapping means and subtracts differential mode components.

The apparatus disclosed has particular applications in the processing of B-format signals.

In accordance with a second aspect of the present invention there is provided an apparatus for sound reproduction of a sound information signal having spatial components, said apparatus comprising:

sound input means adapted to input said sound information signal having spatial components;

sound conversion means connected to said sound input means for converting said sound information signal to corresponding sound emission signals for outputting by said sound emission sources such that the spatial components of said sound information signal are substantially maintained in the presence of movement of the orientation of head of said listener; and said sound conversion means further comprising, for each sound emission source, sound component mapping means mapping each of the spatial components of said sound information signal to a corresponding component sound emission source signal and component summation means connected to each of said sound component mapping means and adapted to combine said component sound emission source signals to produce said corresponding sound emission signal for outputting by said sound emission source.

In accordance with another aspect of the present invention there is provided an apparatus for creating a sound information signal having spatial components, the apparatus comprising:

audio input means for the input of a series of audio signals having substantially no spatial components; and a sound component creation means connected to each of the audio signals and adapted to convert the audio signal to a corresponding sound information signal having spatial components locating the audio signal at a predetermined spatial location at a predetermined time and including reflections and attenuations of the audio signal from the predetermined spatial location.

In accordance with another aspect of the present invention there is provided a method for reproducing sound comprising the steps of:

inputting a sound information signal having spatial components;

determining a current orientation of a predetermined number of sound emission sources around a listener;

rotating the sound information signal in a direction substantially opposite to the current orientation; and outputting the rotated sound information signal on the sound emission sources so that it appears that the apparent sound field is fitted in external orientation independent of movement of the orientation of the predetermined number of sound emission sources.

Preferably, the method further comprises initially creating the sound information signal having spatial components from combining a plurality of audio signals mapped to predetermined positions in a 3-dimensional spatial audio environment the environment including reflections and attenuations of the audio signal.

The reflections and attenuations can be created by utilising simultaneously a number of delayed versions of said audio signal as an input to a plurality of filter functions to simulate the attenuation of each sound, and further deriving spatial components of said predetermined positions from the filtered audio signal.

Preferably, the outputting step further comprises:

determining sound component decoding functions for the spatial components for a plurality of virtual sound emission sources;

determining a head transfer function from each of the virtual sound emission sources to each ear of a prospective listener;

combining the decoding functions and the head transfer functions to form a net transfer function for each the spatial component to each ear of a prospective listener; and utilising the net transfer functions to determine an actual emission source output for each of the sound emission sources.

Preferably the combining step includes substantial simplifications of the net transfer functions where possible.

In accordance with a further aspect of the present invention there is provided a method for reproducing sound comprising the steps of:

inputting a sound information signal having spatial components;

determining a current source position of said sound information signal;

outputting said sound information signal on said sound emission sources so that it appears to be sourced at said current source position, independent of movement of the orientation of said predetermined number of sound emission sources, said outputting step comprising:

determining sound component decoding functions for said spatial components for a plurality of virtual sound emission sources;

determining a head transfer function from each of the virtual sound emission sources to each ear of a prospective listener; and combining said decoding functions and said head transfer functions to form a net transfer function for each said spatial component to each ear of a prospective listener;

utilising said net transfer functions to determine an actual emission source output for each of said sound emission sources.

In accordance with a further aspect there is provided a method for creating, from an audio signal, a sound information signal having spatial components, comprising the steps of:

inputting an audio signal;

determining a predetermined current source position of said sound information signal; and utilising simultaneously a number of delayed versions of said audio signal as an input to a plurality of filter functions to simulate the attenuation of each sound, and further deriving spatial components of said predetermined positions from the filtered audio signal.

BRIEF DESCRIPTION OF THE DRAWINGS

Notwithstanding any other forms which may fall within the scope of the present invention, preferred forms of the invention will now be described, by way of example only, with reference to the accompanying drawings in which.

DESCRIPTION OF PREFERRED AND OTHER EMBODIMENTS

In the preferred embodiment of the present invention, it is assumed that the input sound has three dimensional characteristics and is in an "ambisonic B-format". It should be noted however that the present invention is not limited thereto and can be readily extended to other formats such as SQ, QS, UMX, CD-4, Dolby MP, Dolby surround AC-3, Dolby Pro-logic, Lucas Film THX etc.

The B-format system is a very high quality sound positioning system which operates by breaking down the directionality of the sound into spherical harmonic components termed W, X, Y and Z. The ambisonic system is then designed to utilise all output speakers to cooperatively recreate the original directional components.

For a description of the B-format system, reference is made to:

(1) "General method of theory of auditory localisation", by Michael A Gerzon, 92nd Audio Engineering Society Convention, Vienna 24th–27th March 1992.

(2) "Surround Sound Physco Acoustics", M. A. Gerzon, Wireless World, December 1974, pages 483–486.

(3) U.S. Pat. Nos. 4,081,606 and 4,086,433.

(4) The Internet ambisonic surround sound FAQ available at the following HTTP locations.

http://www.omg.unb.ca/~mleese/http://www.york.ac.uk/inst/mustech/3d_audio/ambison.htm http://jrusby.uoregon.edu/mustech.htm The FAQ is also available via anonymous FTP from pacific.cs.unb.ca in a directory/pub/ambisonic. The FAQ is also periodically posted to the Usenet newsgroups mega.audio.tech, rec.audio.pro, rec.audio.misc, rec.audio.opinion.

Figure 1:
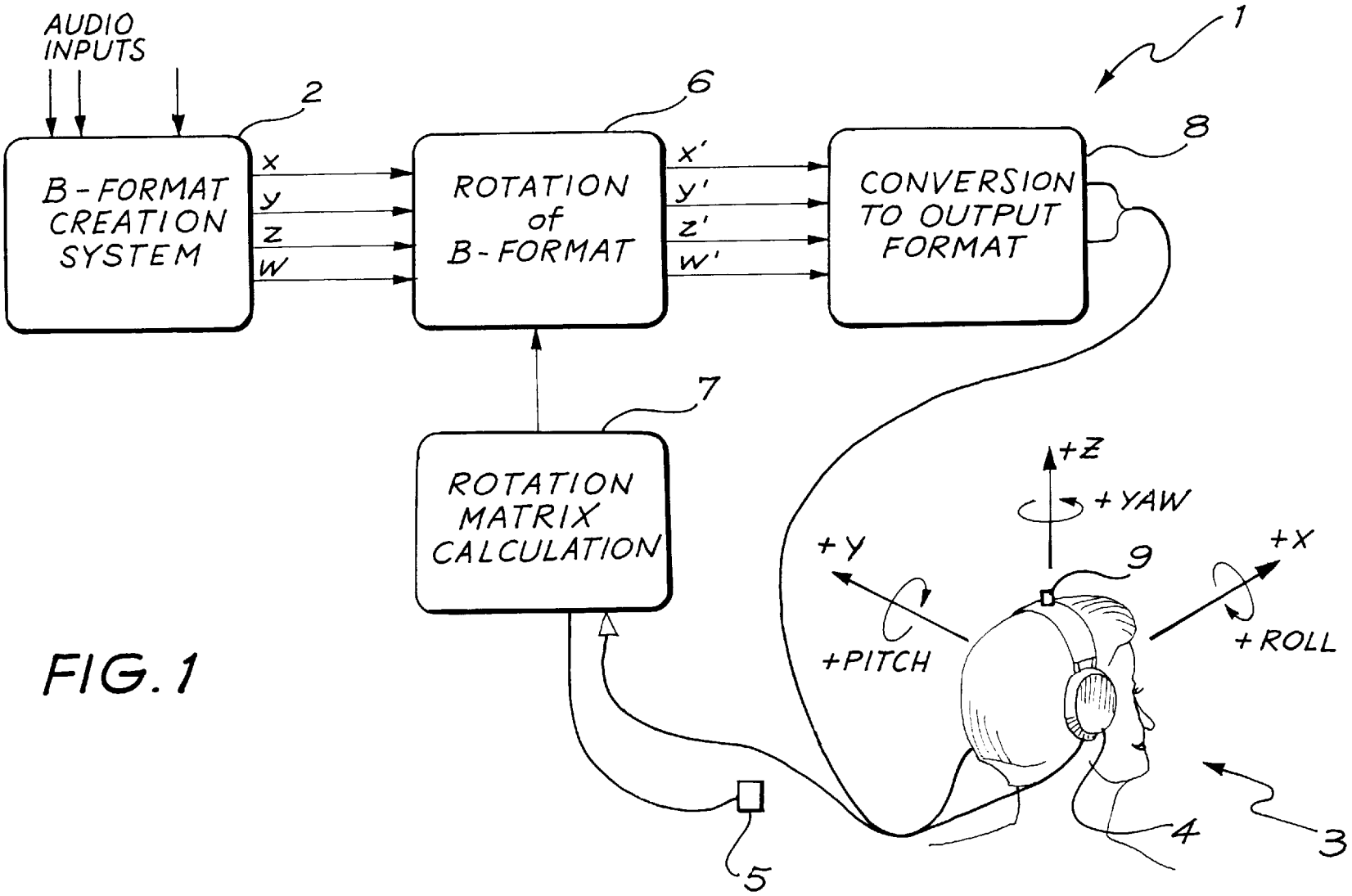
FIG. 1 is a schematic block diagram of the preferred embodiment.

Referring now to FIG. 1, there is illustrated in schematic form, the preferred embodiment 1. The preferred embodiment includes a B-format creation system 2. Essentially, the B-format creation system 2 outputs B-format channel information (X,Y,Z,W) in accordance with the above referenced standard. Simply, the B-format channel information includes three "figure-8 microphone channels" (X,Y,Z), in addition to an omnidirectional channel (W). The B-format creation system 2 creates standard B-format information in accordance with the abovementioned standard. Of course, in an alternative embodiments the B-format information could be prerecorded and an alternative embodiment could then utilise the prerecorded B-format information as an alternative to creating its own. A listener 3 wears a pair of stereo headphones 4 to which is attached a receiver 9 which works in conjunction with a transmitter 5 to accurately determine a current orientation of the headphones 3. The receiver 5 and transmitter 9 are connected to a calculation of rotation matrix means 7. The orientation head tracking means 5, 7 and 9 of the preferred, embodiment was implemented utilising a Polhemus 3 space insidetrak tracking system available from Polhemus, 1 Hercules Drive, PO Box 560, Colchester, Vt. 05446, USA. The tracking system determines a current yaw, pitch and roll of the headphones 4 around three axial coordinates shown.

Given that the output of the B-format creation system 2 is in terms of B-format signals that are related to the direction of arrival from the sound source, then, by rotation 6 of the output coordinates of B-format creation system 2 new outputs X',Y',Z',W' can be produced which compensate for the turning of the listener's 3 head. This is accomplished by rotating the inputs by rotation means 6 in the opposite direction to the rotation coordinates measured by the tracking system. Thereby, if the rotated output is played to the listener 3, through an arrangement of headphones or through speakers attached in some way to the listener's head, for example by a helmet, the rotation of the B-format output relative to the listener's head will create an illusion of the sound sources being located at the desired position in a room, independent of the listener's 3 head angle.

A conversion to output format means 8 then utilises the rotated B-format information, converting it to stereo outputs for output over stereo headphones 4.

Figure 2:
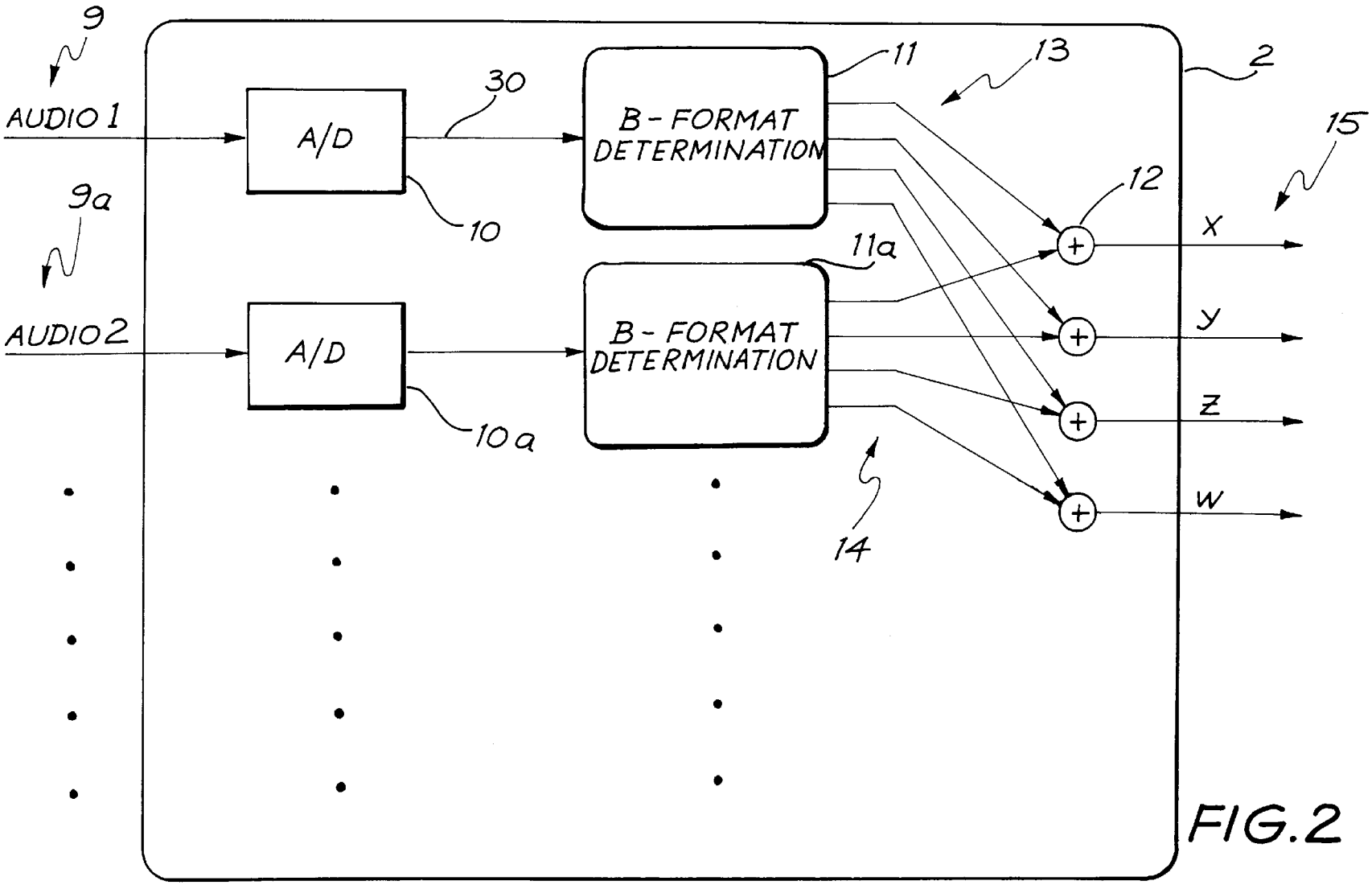
FIG. 2 is a schematic block diagram of the B-format creation system of FIG. 1.

Referring now to FIG. 2, there is shown the B-format creation system 2 of FIG. 1 in more detail. The B-format creation system is designed to accept a predetermined number of audio inputs from microphones, pre-recorded audio, etc of which it is desired to be mixed to produce a particular B-format output. The audio inputs (eg audio 1) at first undergo a process of analogue to digital conversion 10 before undergoing B-format determination 11 to produce X,Y,Z,W B-format outputs 13. The outputs 13 are, as will become more apparent hereinafter, determined through predetermined positional settings in B-format determination means 11.

The other audio inputs e.g. 9*a* are treated in a similar manner, each producing corresponding output in a X,Y,Z,W format e.g. 14 from their corresponding B-format determination means (eg 11*a*) . Each corresponding parts of each B-format outputs are added together 12 to form a final B-format component output eg 15.

Figure 3:
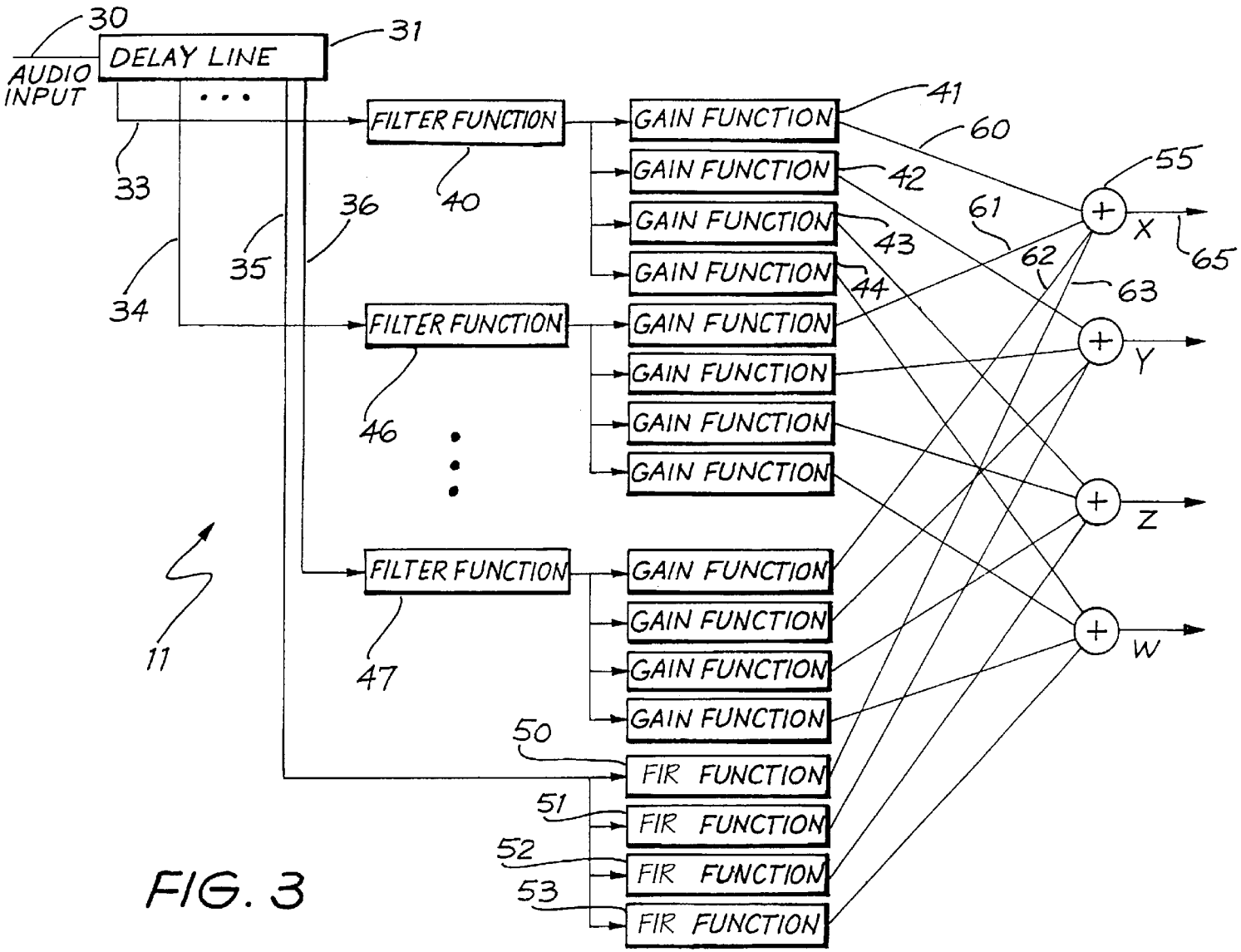
FIG. 3 is a schematic block diagram of the B-format determination means of FIG. 2.

Referring now to FIG. 3, there is illustrated a B-format determination means of FIG. 2 (eg 11), in more detail. The audio input 30, (having previously been analogue to digitally converted) is forwarded to a serial delay line 31. A predetermined number of delayed signals are tapped off, eg. 33–36. The tapping off of delayed signals can be preferably implemented utilising interpolation functions between sample points to allow for sub-sample delay tap off. This can reduce the distortion that can arise when the delay is quantised to whole sample periods including when the delay is changing such as when doppler effects are being produced.

A first of the delayed outputs 33, which is utilised to represent to the direct sound from the sound source to the listener is passed through a simple filter function 40 which can comprise a first or second order lowpass filter. The output of the first filter 40 represents the direct sound from the sound source to the listener. The filter function of filter 40 can be determined to model the attenuation of different frequencies propagated over large distances in air, or whatever other medium is being simulated. The output from filter function 40 thereafter passes through four gain blocks 41–44 which allow the amplitude and direction of arrival of the sound to be manipulated in the B-format. The gain function blocks 41–44 can have their gain levels independently determined so as to locate the audio input 30 in a particular position in accordance with the B-format technique.

A predetermined number of other delay taps eg 34, 35 can be processed in the same way allowing a number of distinct and discrete echoes to be simulated. In each case, the corresponding filter functions eg 46,47 can be utilised to emulate the frequency response effect caused by, for example, the reflection of the sound of a wall in a simulated acoustic space and/or the attenuation of different frequencies propagated over large distances in air. Each of the filter functions eg 46, 47 has an associated delay, a frequency response of a given order, and, when utilised in conjunction with corresponding gain functions, has an independently settable amplitude and direction of the reflected source in accordance with requirements.

One of the delay line taps eg 35, is optionally filtered (not shown) before being supplied to a set of four finite impulse response (FIR), 50–53 which filters can be fixed or can be infrequently altered to alter the simulated space. One FIR filter 50–53 is provided for each of the B-format components so as to simulate the reverberant tail of the sound.

Each of the corresponding B-format components eg 60–63, are then added together 55 to produce the B-format component output 65. The other B-format components being treated in a like manner.

Referring again FIG. 2, each audio channel utilises its own B-format determination means to produce corresponding B-format outputs eg 12–15, which are then added together 19 to produce an overall B-format output 20. Alternatively, the various FIR filters (50–53 of FIG. 3) can be shared amongst multiple audio sources. This alternative can be implemented by summing together multiple delayed sound source inputs before being forwarded to FIR filters 50–53.

Of course, the number of filter functions eg 40, 46, 47 is variable and is dependent on the number of discrete echoes that are to be simulated. In a typical system, seven separate sound rivals can be simulated corresponding to the direct sound plus six first order reflections. An eighth delayed signal can be fed to the longer FIR filters to simulate the reverberant tail of the sound.

Referring again to FIG. 1, as noted previously, the head tracking system 5, 9 forwards yaw, pitch and roll data to rotation matrix calculation means 7.

From the yaw, pitch and roll of the head measured by the tracking system, the rotation matrix calculation means 7 computes a rotation matrix R that defines the mapping of X,Y,Z vector coordinates from a room coordinate system to the listener's own head related coordinate system. Such a matrix R can be defined as follows (Equation 1):

$$R = \begin{bmatrix} 1 & 0 & 0 \\ 0 & \cos(\text{roll}) & \sin(\text{roll}) \\ 0 & -\sin(\text{roll}) & \cos(\text{roll}) \end{bmatrix} \times \begin{bmatrix} \cos(\text{pitch}) & 0 & -\sin(\text{pitch}) \\ 0 & 1 & 0 \\ \sin(\text{pitch}) & 0 & \cos(\text{pitch}) \end{bmatrix} \times \begin{bmatrix} \cos(\text{yaw}) & \sin(\text{yaw}) & 0 \\ -\sin(\text{yaw}) & \cos(\text{yaw}) & 0 \\ 0 & 0 & 1 \end{bmatrix}$$

The corresponding rotation calculation means 7 can consist of a suitably programmed digital signal processing (DSP) digital computing device that takes the pitch, yaw and roll values from the head tracking system 5,9 and calculates R in accordance with the above equation. In order to maintain a suitable audio image as the listener 3 turns his or her head, the matrix R should be updated regularly. Preferably, it should be updated at intervals of no more than 100 ms, and more preferably at intervals of no more than 30 ms. Such update rates are within the capabilities of modern DSP chip arrangements.

The calculation of R means that it is possible to compute the X,Y,Z location of a sound source relative to the listener's 3 head coordinate system, based on the X,Y,Z location of the source relative to the room coordinate system. This calculation is as follows (Equation 2):

The rotation of the B-format by rotation of B-format means 6 can be carried out by a suitably programmed DSP computer device programmed in accordance with the $$\begin{bmatrix} X_{head} \\ Y_{head} \\ Z_{head} \end{bmatrix} = [R]X \begin{bmatrix} X_{room} \\ Y_{room} \\ Z_{room} \end{bmatrix}$$

following equation:

$$\begin{bmatrix} X_{head} \\ Y_{head} \\ Z_{head} \\ W_{head} \end{bmatrix} = \begin{bmatrix} & & & 0 \\ & R & & 0 \\ & & & 0 \\ 0 & 0 & 0 & 1 \end{bmatrix} \times \begin{bmatrix} X_{room} \\ Y_{room} \\ Z_{room} \\ W_{room} \end{bmatrix}$$

Hence, the conversion from the room related X,Y,Z,W signals to the head related X',Y',Z',W' signals can be performed by composing each of the $X_{head}$, $Y_{head}$, $Z_{head}$ signals as the sum of the three weighted elements $X_{room}$,$Y_{room}$, $Z_{room}$. The weighting elements are the nine elements of the 3×3 matrix R. The W' signal can also be directly copied from W.

The next step is to convert the outputted rotated B-format data to the desired output format by a conversion to output format means 8. In this case, the output format to be fed to headphones 4 is a stereo format and a binaural rendering of the B-format data is required.

Figure 4:
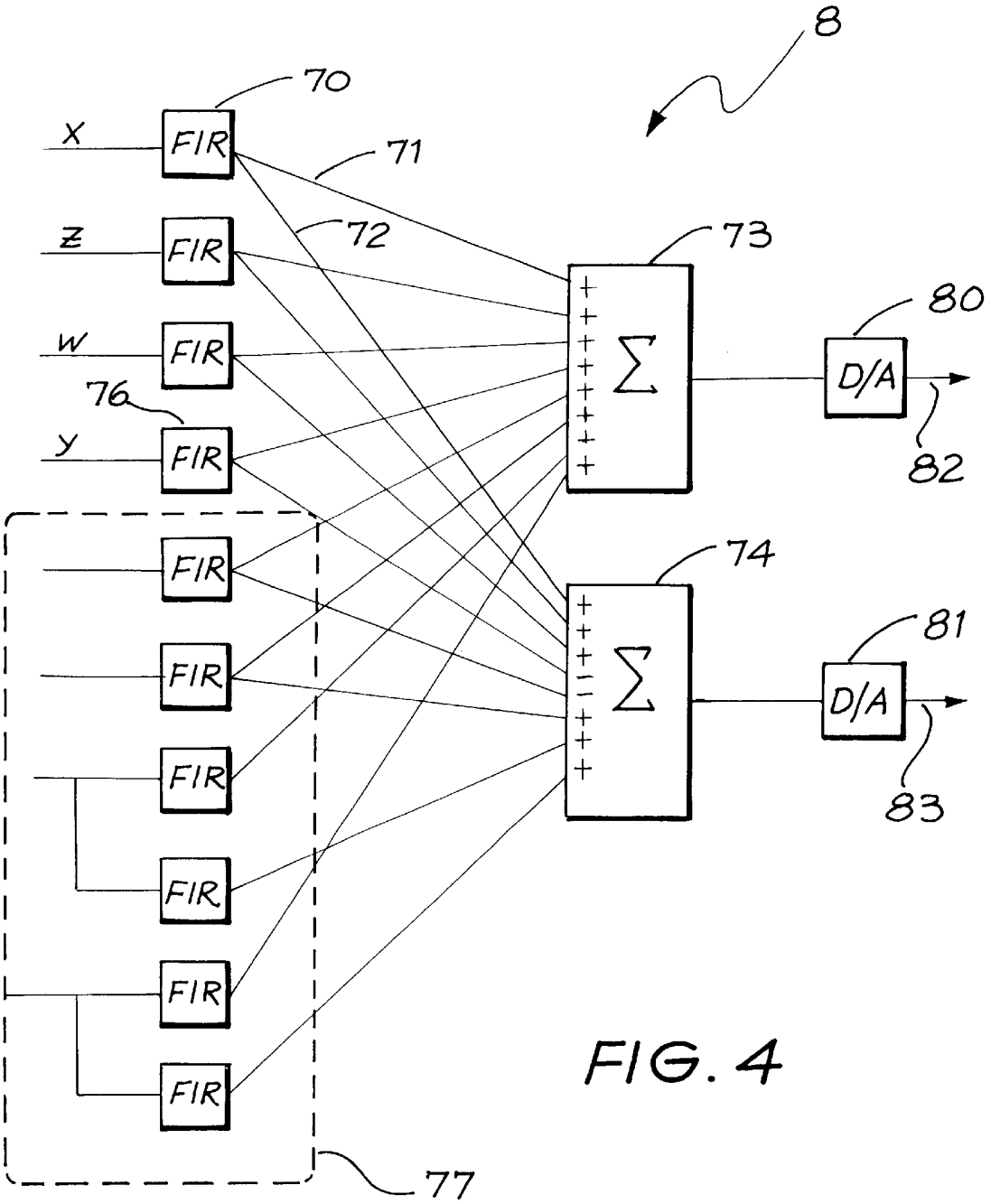
FIG. 4 is a schematic block diagram of one form of the conversion to output format means of FIG. 1.

Referring now to FIG. 4, there is illustrated the conversion to output format means 8 in more detail. Each component of the B-format signal is preferably processed through one or two short filtering elements eg 70, which typically comprises a finite impulse response filter of length between 1 and 4 milli sec. Those B-format components that represent a "common-mode" signal to the ears of a listener (such as the X,Z or W components of the B-format signal) need only be processed through one filter each. The outputs e.g. 71, 72 being fed to summers 73, 74 for both the left and right headphone channels. As will be explained hereinafter, the B-format components that represent a differential signal to the ears of a listener, such as the Y component of the B-format signal, need only be processed through one filter eg 76, with the filter 76 having its outputs summed to the left headphone channel summer 73 and subtracted from the right headphone channel summer 74.

The ambisonic system described in the aforementioned reference provides for higher order encoding methods which may involve more complex ambisonic components. Although the preferred embodiment has described with reference to the lower order system, it will be evident that the conversion to output format means 8 of FIG. 4 can be readily extended to deal with these optional additional components 77. The more complex components can include a mixture of differential and common mode components at the listener's ears which can be independently filtered for each ear with one filter being summed to the left headphone channel and one filter being summed to the right headphone channel.

The outputs from summer 73 and summer 74 can then be converted 80, 81 into an analogue output 82, 83 for forwarding to the left and right headphone channels respectively.

Figure 5:
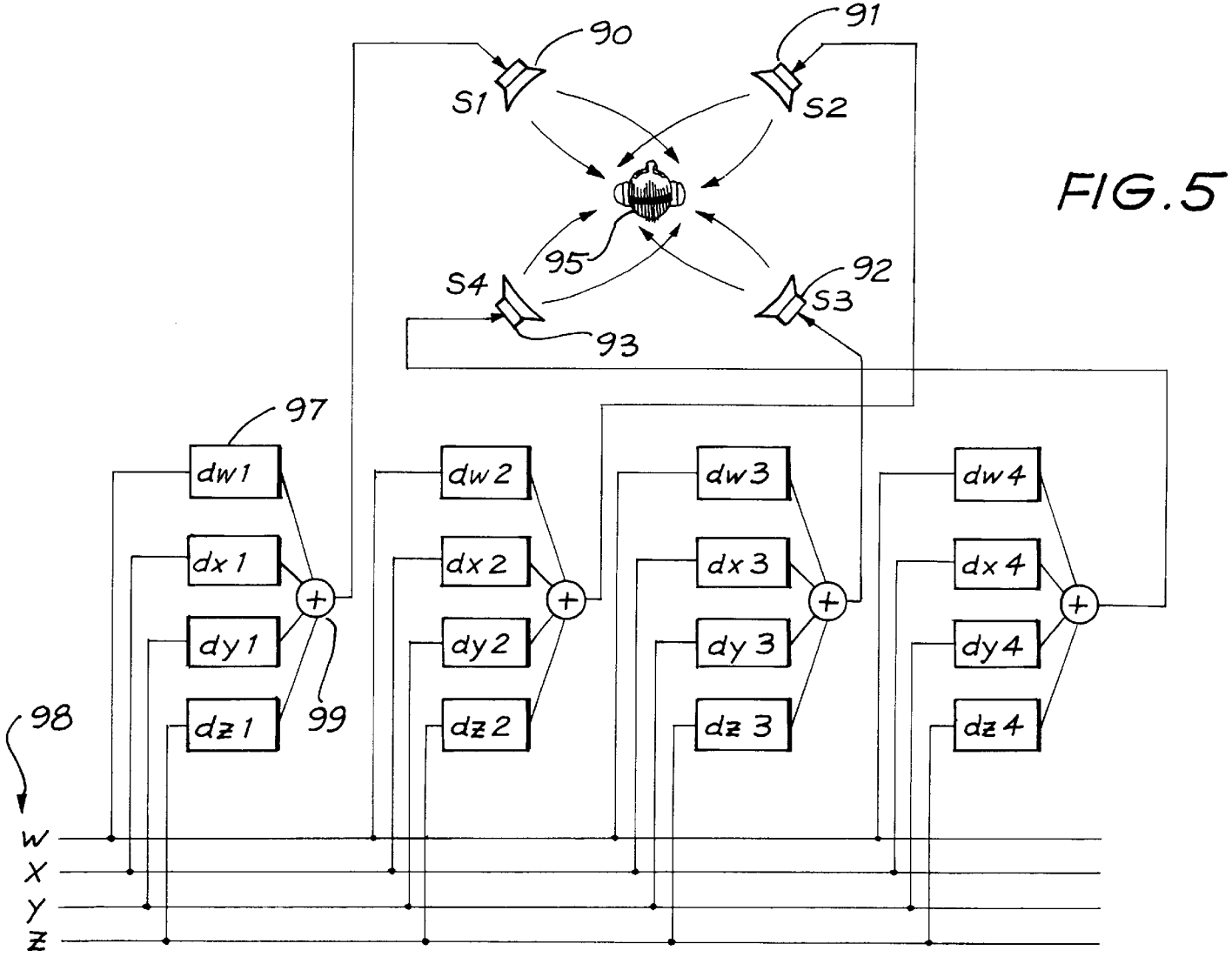
FIG. 5 to FIG. 7 illustrate the derivation of the arrangement of the conversion to output format means of FIG. 4.

Referring now to FIG. 5, there will now be described one method of determining the filter coefficients for the FIR filters eg 70 of FIG. 4. The FIR filters can be determined by imagining a number of evenly spaced, symmetrically located virtual speakers 90, 91, 92 and 93 arranged around the head of a listener 95. A head related transfer function is then determined from each virtual loudspeaker 90–93 to each ear of the listener 95. For example, the head related transfer function from virtual speaker j to the left ear can be denoted $h_{j,L}(t)$ and the head related transfer function from virtual speaker j to the right ear can be denoted $h_{j,R}(t)$ etc.

Next, decoding functions eg 97 are then determined for conversion of B-format signals 98 into the correct virtual speaker signals. The decoding functions 97 can be implemented utilising commonly used methods for decoding the B-format signals over multiple loud speakers as described in the aforementioned references. The decoding functions for each B-format component 98 are then added together 99 for forwarding to the corresponding speaker eg 90. A similar decoding step is likewise carried out for each of the other speakers 91–93.

The loudspeaker decoding functions are then combined with the head related transfer functions to form a net transfer function (an impulse response) from each B-format signal component to each ear. The responses from each B-format component will be the sum of all the speaker responses where the response of each speaker is the convolution of the decode function $d_{ij}$, where i is the B-format component and j is the speaker number with n being the number of virtual speakers. The convolution can be expressed as follows:

$$b_{i,L}(t) = \sum_{j=1}^{n} d_{i,j} \otimes h_{j,L}$$

$$b_{i,R}(t) = \sum_{j=1}^{n} d_{i,j} \otimes h_{j,R}$$

Figure 6:
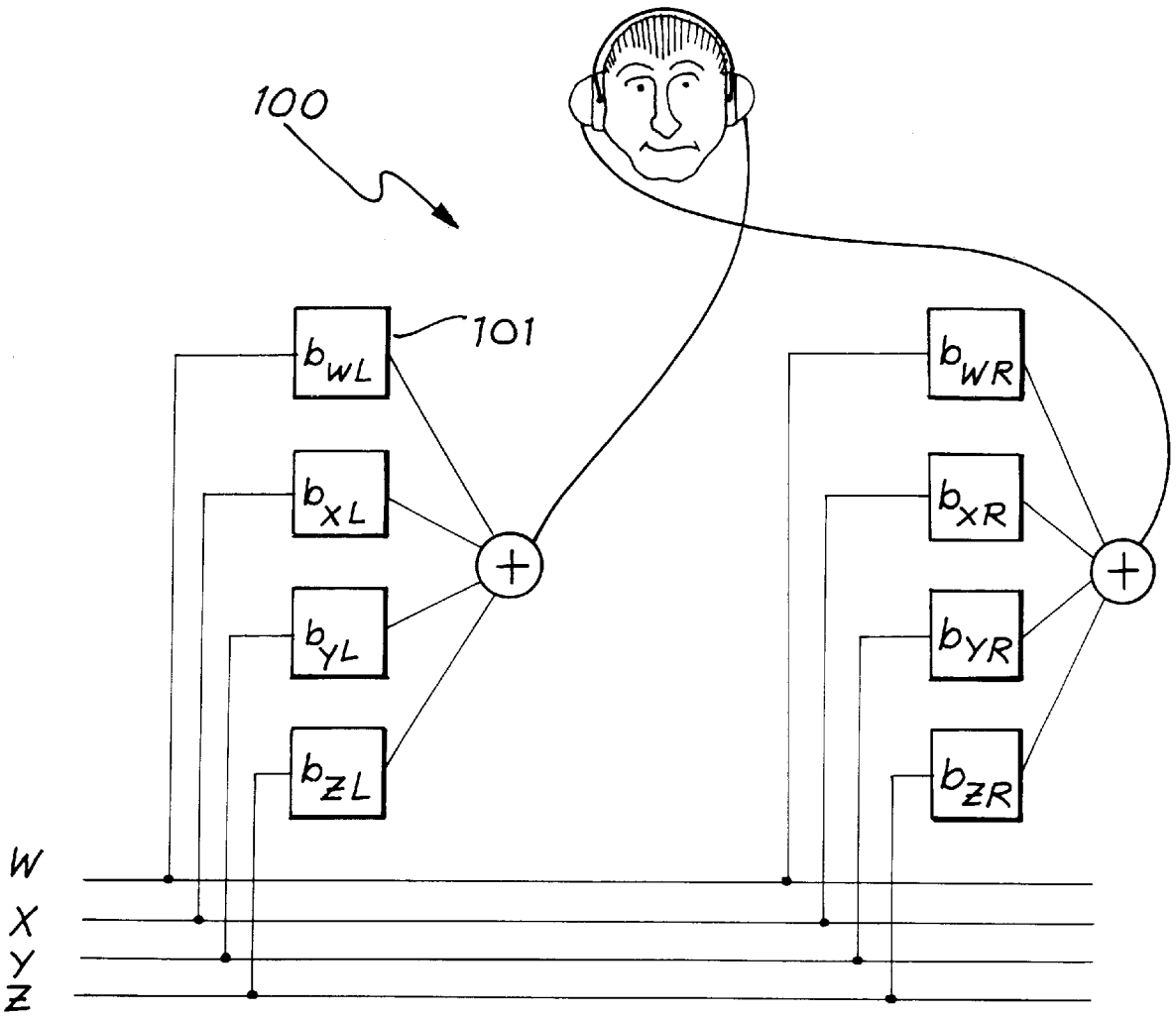

Referring to FIG. 6, there is illustrated a first arrangement 100 of the conversion to output format means corresponding to the above mentioned equation. The arrangement of 100 of FIG. 6 includes separate B-format component filters eg 101 in accordance with the abovementioned formula.

Figure 7:
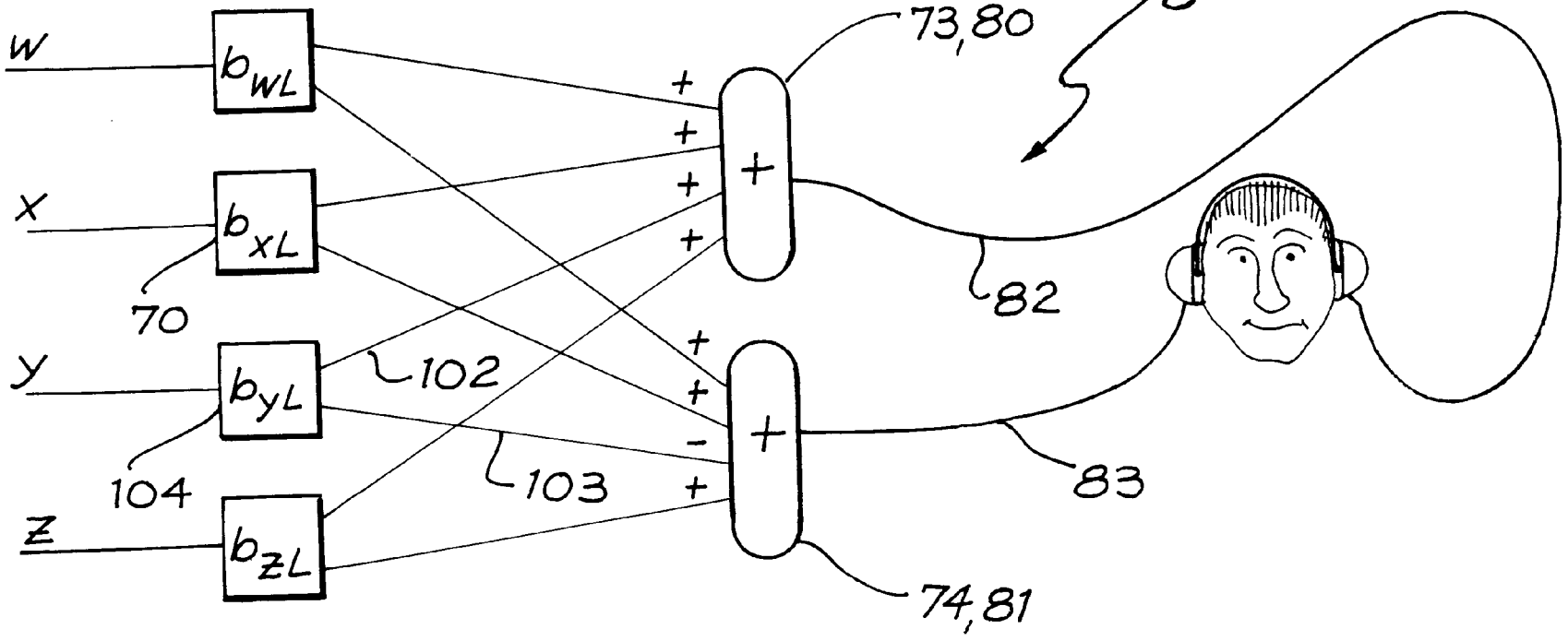

It has been found that a number of the B-format signal components have substantially the same filter components as a result of having substantially the same, within the limits of computation errors and noise, impulse responses to both ears. In this situation, a single impulse response can be utilised for both ears with the component of the B-format being considered a common mode component. This was found to be substantially the case for the W,X and Y components. Further, it was found that some of the B-format signal components have the opposite, within the limits of computational error and noise, impulse responses to both ears. In this case a single response can be utilised and the B-format component can be considered to be a differential component being added to one ear and subtracted to from the other. This was found to be particularly the case with the Y component. Hence, referring now to FIG. 7, there is illustrated a simplified form of the conversion to output format means 8 corresponding to the arrangement of FIG. 4 without the mixed mode components. Importantly, the Y component being a differential component is filtered 104 before being added 102 to a first headphone channel and subtracted 103 from the other headphone channel.

It should be noted that the number of virtual speakers chosen in the arrangement of FIG. 5 does not substantially impact on the amount of processing required to implement the overall conversion from the B-format component to the binaural components as, once the filter elements eg 70 (FIG. 4) have been calculated, they do not require further alteration.

The aforementioned simplified method can then be utilised to derive the FIR filter coefficients for FIR filters eg 70 within the conversion to output means 8.

These FIR coefficients can be precomputed and a number of FIR coefficient sets may be utilised for different listeners matched to each individual's head related transfer function. Alternatively, a number of sets of precomputed FIR coefficients can be used to represent a wide group of people, so that any listener may choose the FIR coefficient set that provides the best results for their own listening. These FIR sets can also include equalisation for different headphones.

The signal processing requirements of the preferred embodiment can be implemented on a modern DSP chip arrangement, preferably integrated with PC hardware or the like. For example, one form of suitable implementation of the preferred embodiment can be implemented on the Motorola 56002 EVM evaluation board card designed to be inserted into a PC type computer and directly programmed therefrom and having suitable Analogue/Digital and Digital/Analogue converters. The DSP board, under software control, allowing for the various alternative head related transfer functions to be utilised.

It should be further noted that the present invention also has significant general utility in firstly converting B-format signals to stereo outputs. A simplified form of the preferred embodiment could dispense with the rotation of the B-format means and utilise ordinary stereo headphones. Further, the B-format creation system of FIG. 3 has the ability to create B-format signals having rich oral surroundings and is, in itself, of significant utility.

It will be obvious to those skilled in the art that the above system has application in many fields. For example, virtual reality, acoustics simulation, virtual acoustic displays, video games, amplified music performance, mixing and post production of audio for motion pictures and videos are just some of the applications. It will also be apparent to those skilled in the art that the above principles could be utilised in a system based around an alternative sound format having directional components.

The foregoing describes an embodiment of the present invention and minor alternative embodiments thereto. Further modifications, obvious to those skilled in the art, can be made without departing from the scope of the present invention.

I claim:

1. An apparatus for sound reproduction of a sound information signal having spatial components describing the sound as it arrives at a listening position in a predetermined sound environment, said apparatus comprising:

sound input means adapted to input said sound information signal;

headtracking means for tracking a current head orientation of a listener listening to said sound information signal via sound emission sources and to produce a corresponding head orientation signal;

sound information rotation means connected to said sound input means and said headtracking means and adapted to rotate said sound information signal through the multiplication of said sound information signal by a geometric rotation matrix having coefficients determined by said head orientation signal to a substantially opposite degree to the degree of orientation of said current head orientation of said listener to produce a rotated sound information signal; and sound conversion means connected to said sound information rotation means for converting said rotated sound information signal to corresponding sound emission signals for outputting by said sound emission sources such that the spatial components of said sound information signal are substantially maintained in the presence of movement of the orientation of head of said listener.

2. An apparatus as claimed in claim 1 wherein said sound conversion means includes, for each sound emission source:

sound component mapping means mapping each of the spatial components of said sound information signal to a corresponding component sound emission source signal; and component summation means connected to each of said sound component mapping means and adapted to combine said component sound emission source signals to produce said corresponding sound emission signal for outputting by said sound emission source.

3. An apparatus as claimed in claim 2 said sound information signal include common mode and differential mode component and said component summation means adds together common mode components from corresponding sound component mapping means and subtracts differential anode components.

4. An apparatus as claimed in claim 1 wherein said sound information signal comprises a B-format signal.

5. An apparatus as claimed in claim 1 wherein said headtracking means updates the current head orientation of a listener at intervals of less than 100 milliseconds.

6. An apparatus as claimed in claim 5 wherein said headtracking means updates the current head orientation of a listener at intervals of less than 30 milliseconds.

7. An apparatus for sound reproduction of a series of audio signals, said apparatus comprising:

audio input means for the input of said series of audio signals having substantially no spatial components;

a sound component creation means connected to each of said audio signals and adapted to convert said audio signal to a corresponding sound information signal having spatial components describing the sound as it arrives at a listening position in a particular sound environment;

headtracking means for tracking a current head orientation of a listener listening to said sound information signal via sound emission sources and to produce a corresponding head orientation signal;

sound information rotation means connected to said sound input means and said headtracking means and adapted to rotate said sound information signal through the multiplication of said sound information by a geometric rotation matrix having coefficients determined by said head orientation signal, to a substantially opposite degree of orientation of said current head orientation of said listener to produce a rotated sound information signal; and sound conversion means connected to said sound information signal rotation means for converting said rotated sound information signal to corresponding sound emission signals for outputting by said sound emission sources such that the spatial components of said sound information signal are substantially maintained in the presence of movement of the orientation of the head of said listener.

8. An apparatus for sound reproduction as claimed in claim 7 wherein said sound component creation means includes means for combining said corresponding sound information signals into a single sound information signal having spatial components.

9. An apparatus for sound reproduction as claimed in claim 7 wherein said sound component creation means includes environment creation means for creating a simulated environment for said audio signal including reflections and attenuations of said audio signal from said predetermined spatial location.

10. An apparatus as claimed in claim 9 wherein said environment creation means includes;

a delay line connected to said audio signal for producing a number of delayed versions of said audio signal;

a series of sound sub-component creation means, connected to said delay line, each for creating a single sound arrival signal at the expected location of said listener;

a sound sub-component summation means, connected to each of said sound sub-component creation means and adapted to combine said single sound arrival signals so as to create said simulated environment.

11. An apparatus as claimed in claim 10 wherein said sound sub-component creation means comprises an attenuation filter, simulating the likely attenuation of said arrival signal, connected to a series of sub-component direction means creating directional components of said sound signal simulating an expected direction of arrival of said signal.

12. An apparatus as claimed in claim 10 wherein said environment creation means further includes a reverberant tail simulation means connected to said delay line and said sound sub-component creation means and adapted to simulate the reverberant tail of the arrival of said audio signal.

13. An apparatus for sound reproduction of a sound information signal having spatial components describing the sound as it arrives at a listening position in a predetermined sound environment, said apparatus comprising:

sound input means adapted to input said sound information signal having spatial components describing the sound as it arrives at a listening position in a predetermined sound environment;

sound conversion means connected to said sound input means for converting said sound information signal to corresponding sound emission signals for outputting by said sound emission sources such that the spatial components of said sound information signal are substantially maintained in the presence of movement of the orientation of head of said listener through the multiplication of said sound information signal by a geometric rotation Matrix having coefficients determined by a head orientation signal derived from a current orientation position of the head of said listener, and said sound conversion means further comprising, for each sound emission source, sound component mapping means mapping each of the spatial components of said sound information signal to a corresponding component sound emission source signal and component summation means connected to each of said sound components mapping means and adapted to combine said component sound emission source signals to produce said corresponding sound emission signal for outputting by said sound emission source.

14. An apparatus as claimed in claim 13 wherein said spatial component of said sound information signal include common mode and differential mode component and said component summation means adds together common mode components from corresponding sound component mapping means and subtracts differential mode components.

15. A method for reproducing sound comprising the steps of:

inputting a sound information signal having spatial components describing the sound as it arrives at a listening position in a predetermined sound environment;

determining a current orientation of a predetermined number of sound emission sources around a listener;

rotating said sound information signal in a direction substantially opposite to said current orientation through the multiplication of said sound information signal by a geometric rotation matrix having coefficients determined by the current orientation of said sound emission sources to form a rotated sound information signal; and outputting said rotated sound information signal on said sound emission sources so that the apparent sound field is fixed in external orientation, independent of movement of the orientation of said predetermined number of sound emission sources.

16. A method as claimed in claim 15 further comprising the step of initially creating said sound information signal hang spatial components describing the sound as it arrives at a listening position in a predetermined environment, from combining a plurality of audio signals mapped to predetermined positions in a 3-dimensional spatial audio environment.

17. A method as claimed in claim 16 wherein said environment includes reflections and attenuation of said audio signal.

18. A method as claimed in claim 17 wherein said step of initially creating said sound information signal comprises, for each audio signal:

utilizing simultaneously a number of delayed versions of said audio signal as an input to a plurality of filter functions to simulate the attenuation of each sound, and further deriving spatial components of said predetermined positions form the filtered audio signal.

19. A method as claimed in claim 18 wherein said step of initially creating said information signal further comprises, for each audio signal, utilizing a filter simulating the reverberant tail of said audio signal in said environment.

20. A method as claimed in claim 15 wherein said outputting step further comprises:

determining sound component decoding functions for said spatial components for a plurality of virtual sound emission sources;

determining a head transfer function from each of the virtual sound emission sources to each ear of a prospective listener; and combining said decoding function and said head transfer functions to form a net transfer function for each said spatial component to each ear of a prospective listener; and utilizing said net transfer functions to determine an actual emission source output for each of said sound emission sources.

21. A method as claimed in claim 20 wherein said combining step further comprises determining those functions which are substantially the same or are substantially the opposite of one another and, in each case, utilizing the same net transfer function for corresponding emission sources.

22. A method as claimed in claim 21 wherein the number of emission sources is two.

23. A method as claimed in claim 15 wherein said outputting step comprises:

determining sound component decoding functions for said spatial components for a plurality of virtual sound emission sources;

determining a head transfer function from each of the virtual sound emission sources to each ear of a prospective listener; and combining said decoding functions and said head transfer functions to form a net transfer function for each said spatial component to each ear of a prospective listener;

utilizing said net transfer fictions to determine an actual emission source output for each of said sound emission sources.

* * * * *

UNITED STATES PATENT AND TRADEMARK OFFICE

CERTIFICATE OF CORRECTION

PATENT NO. : 6,021,206

DATED : February 1, 2000

INVENTOR(S) : David Stanley McGrath

It is certified that error appears in the above-identified patent and that said Letters Patent is hereby corrected as shown below:

Column 11, line 11, delete "anode" and insert --mode--;

Column 14, line 27, delete "fictions" and insert --functions--.

Signed and Sealed this

Fourteenth Day of November, 2000

*Attest:*

Q. TODD DICKINSON

*Attesting Officer*

*Director of Patents and Trademarks*